US009970607B2

(12) United States Patent
Doyon

(10) Patent No.: US 9,970,607 B2
(45) Date of Patent: May 15, 2018

(54) RETRACTABLE LIGHTING ASSEMBLY

(71) Applicant: EKLIPSE LUMINAIRE ARCHITECTURAL INC., Montréal (CA)

(72) Inventor: Jean-Christophe Doyon, Terrebonne (CA)

( * ) Notice: Subject to any disclaimer, the term of this patent is extended or adjusted under 35 U.S.C. 154(b) by 86 days.

(21) Appl. No.: 14/896,613

(22) PCT Filed: Jun. 6, 2014

(86) PCT No.: PCT/CA2014/050525
§ 371 (c)(1),
(2) Date: Dec. 7, 2015

(87) PCT Pub. No.: WO2014/194430
PCT Pub. Date: Dec. 11, 2014

(65) Prior Publication Data

US 2016/0131317 A1 May 12, 2016

Related U.S. Application Data

(60) Provisional application No. 61/831,923, filed on Jun. 6, 2013.

(51) Int. Cl.
*F21S 8/02* (2006.01)
*F21V 3/04* (2006.01)
(Continued)

(52) U.S. Cl.
CPC ..... *F21S 8/028* (2013.01); *F21V 3/049* (2013.01); *F21V 14/02* (2013.01); *F21Y 2103/10* (2016.08); *F21Y 2115/10* (2016.08)

(58) Field of Classification Search
CPC ..... F21S 8/028; F21V 3/049; F21V 15/013; F21V 14/02; F21Y 2103/10; F21Y 2103/20; F21Y 2115/10
(Continued)

(56) References Cited

U.S. PATENT DOCUMENTS 3,518,420 A * 6/1970 Kripp ..... F21S 8/02 248/343
4,180,850 A 12/1979 Bivens
(Continued)

FOREIGN PATENT DOCUMENTS

DE 3516839 A1 * 11/1986 ..... F21S 8/028
JP 08083510 A * 3/1996 ..... F21S 8/02

OTHER PUBLICATIONS

Motohashi et al, [JP,08-083510,A(1996)], English Translation of JP 08083510 A, pp. 1-10.*
(Continued)

*Primary Examiner* — Alan Cariaso
(74) *Attorney, Agent, or Firm* — Benoit & Cote, Inc.; C. Marc Benoit

(57) ABSTRACT

A lighting assembly, mounted within a cavity of a structure having an exposed outer surface, includes a lighting source having a light output surface and a push-retract mechanism. The push-retract mechanism includes at least one biasing assembly operable to displace the lighting source between an extended position where the light output surface extends beyond the outer surface of the structure, and a retracted position, where the light output surface does not extend beyond the outer surface of the structure.

21 Claims, 5 Drawing Sheets

(51) Int. Cl.
*F21V 14/02* (2006.01)
*F21Y 103/10* (2016.01)
*F21Y 115/10* (2016.01)

(58) Field of Classification Search
USPC ..... 362/288
See application file for complete search history.

(56) References Cited

U.S. PATENT DOCUMENTS

| | | | | |
|---|---|---|---|---|
| 4,429,355 | A | 1/1984 | Garchinsky | |
| 4,984,139 | A | 1/1991 | Goggia | |
| 5,003,441 | A | 3/1991 | Crowe et al. | |
| 5,124,902 | A | 6/1992 | Puglisi | |
| 5,130,916 | A | 7/1992 | Toth | |
| 5,142,463 | A | 8/1992 | Panagotacos et al. | |
| 5,156,454 | A | 10/1992 | White | |
| 5,513,085 | A | 4/1996 | Bourne | |
| 5,758,959 | A * | 6/1998 | Sieczkowski | F21S 8/026 362/148 |
| 7,712,913 | B2 * | 5/2010 | Gardenier | A47K 3/001 362/101 |
| 8,297,804 | B2 * | 10/2012 | Buse | F21V 21/04 362/147 |
| 2007/0047229 | A1 * | 3/2007 | Lee | F21V 5/04 362/237 |
| 2009/0290340 | A1 * | 11/2009 | Hayakawa | F21S 8/026 362/235 |

OTHER PUBLICATIONS

Blum, Description DE3516839, Patent Translate Powered by EPO and Google, pp. 1-3.*

* cited by examiner

RETRACTABLE LIGHTING ASSEMBLY

This application is a National Stage Application of PCT/CA2014/050525, filed 6 Jun. 2014, which claims benefit of U.S. Provisional Application Ser. No. 61/831,923, filed 6 Jun. 2013 and which applications are incorporated herein by reference. To the extent appropriate, a claim of priority is made to each of the above disclosed applications.

FIELD OF THE INVENTION

The present invention relates to a lighting assembly. More particularly, the present invention relates to a lighting assembly which is retractable within a structure, such as a ceiling, wall or floor.

BACKGROUND

Recessed lights are known in the art. Such lights can be used to illuminate a room or similar space.

When recessed lights are used in ceilings, they can be referred to as "linear recessed lights", "pot lights" or "can lights". Such lights are mounted within the ceiling and are visible to the naked eye because of a trim or ring which is used to secure the light in place, and which hides the bulb of the light from view. The trim also serves as a grabbing implement to provide a means to pull the light out of the recess. Recessed lights can have various geometrical shapes, such as round, rectangular, etc. Although most often used for ceilings, recessed lights can be used for horizontal or bottom partitions such as walls or floors.

For some applications, however, the accessories of traditional recessed lights, such as the trim or ring, are considered too unsightly. In these applications, it is often desired to provide recessed lighting where the trims, rings, bulb, and other associated paraphernalia are not visible. This can be difficult if not impossible to achieve with known recessed lights.

A further disadvantage associated with some recessed lights is that they can be relatively difficult to maintain and repair. In many instances, once a recessed light is installed within a partition, it cannot be quickly and easily removed so as to replace the bulb, for example. The use of hand tools is often required, which increases the time required for such work. In some instances, an individual may not have the necessary tools for maintenance or repair at hand, thereby rendering the operation much more tedious.

Yet another disadvantage associated with some recessed lights is that they can be relatively difficult to adjust. In many instances, recessed lights are installed in a fixed position. If the recessed lights are perturbed or shift of their own volition, which is known to occur, additional effort and labor is required to return them to their proper position.

Hence, in light of the aforementioned, there is a need for a device which, by virtue of its design and components, would be able to overcome or at least minimize some of the aforementioned prior art problems.

SUMMARY

The object of the present invention is to provide a lighting assembly which, by virtue of its design and components, satisfies at least some of the above-mentioned needs and is thus an improvement over other related devices and/or methods known in the art.

According to one aspect, there is provided a lighting assembly mounted within a cavity of a structure having an exposed outer face.

The lighting assembly includes a lighting source having a light output surface, and a push-retract mechanism. The push-retract mechanism has at least one biasing assembly operable to displace the lighting source between an extended position, where the light output surface extends beyond the outer surface of the structure, and a retracted position, where the light output surface does not extend beyond the outer surface of the structure.

In some optional embodiments, the push-retract mechanism comprises a displacement mounting to which the lighting source is attached.

In some embodiments, when the push-retract mechanism is in the retracted position the light output surface of the lighting source is substantially level with the outer surface of the structure. In other embodiments, the light output surface is recessed within the cavity. In either case, the lighting source would be difficult to grab or otherwise take hold of in order to access it, and the push-retract mechanism provides a convenient means to access or remove the lighting source despite the absence of a proper hold.

In some optional embodiments, the lighting source can include a housing, and one or more light emitters enclosed in the housing. In some optional embodiments, the one or more light emitters can comprise LEDs, bulbs, fluorescents, or the like. Further optionally, the lighting source can be magnetically mounted to, and removed from, the push-retract mechanism. Further optionally, the housing is made of or includes a thermally-dissipating material.

In some optional embodiments, the housing can comprise a top end opposite the output surface, and the lighting assembly can further include an attachment mechanism configured to attach the top end of the housing to the push-retract mechanism. For example, the attachment mechanism can involve a magnetic strip affixed to the top end of the housing. In some implementations, the attachment mechanism is a grooved extrusion running the length of the top end of the housing.

In some optional embodiments, the biasing assembly can include a device which produces a biasing force, for example a spring or the like.

According to another aspect, there is provided a set for mounting a lighting assembly within a cavity of a structure having an exposed outer surface, comprising:

- a lighting source having a light output surface; and
- a push-retract mechanism mountable within the cavity and to which the lighting source is attachable, comprising at least one biasing assembly operable so that when the push-retract mechanism is mounted within the cavity and the lighting source is attached thereto, the lighting source can be displaced between an extended position where the light output surface extends beyond the outer surface of the structure, and a retracted position, where the light output surface does not extend beyond the outer surface of the structure.

Implementations may advantageously provide a lighting assembly which can be placed within a cavity of a structure (e.g. a ceiling, a wall or a floor) and made flush with the structure or recessed therein, and which can easily be removed from within the cavity of the structure for various purposes (e.g. maintenance, bulb replacement, or cleaning).

The objects, advantages and other features of the present invention will become more apparent upon reading of the following non-restrictive description of its optional embodiments, which is given for illustrative purposes only, with reference to the accompanying drawings.

BRIEF DESCRIPTION OF THE DRAWINGS

FIG. 4 is a perspective view of a lighting assembly being shown in a retracted position, according to an.

DETAILED DESCRIPTION OF EMBODIMENTS

Figure 1:
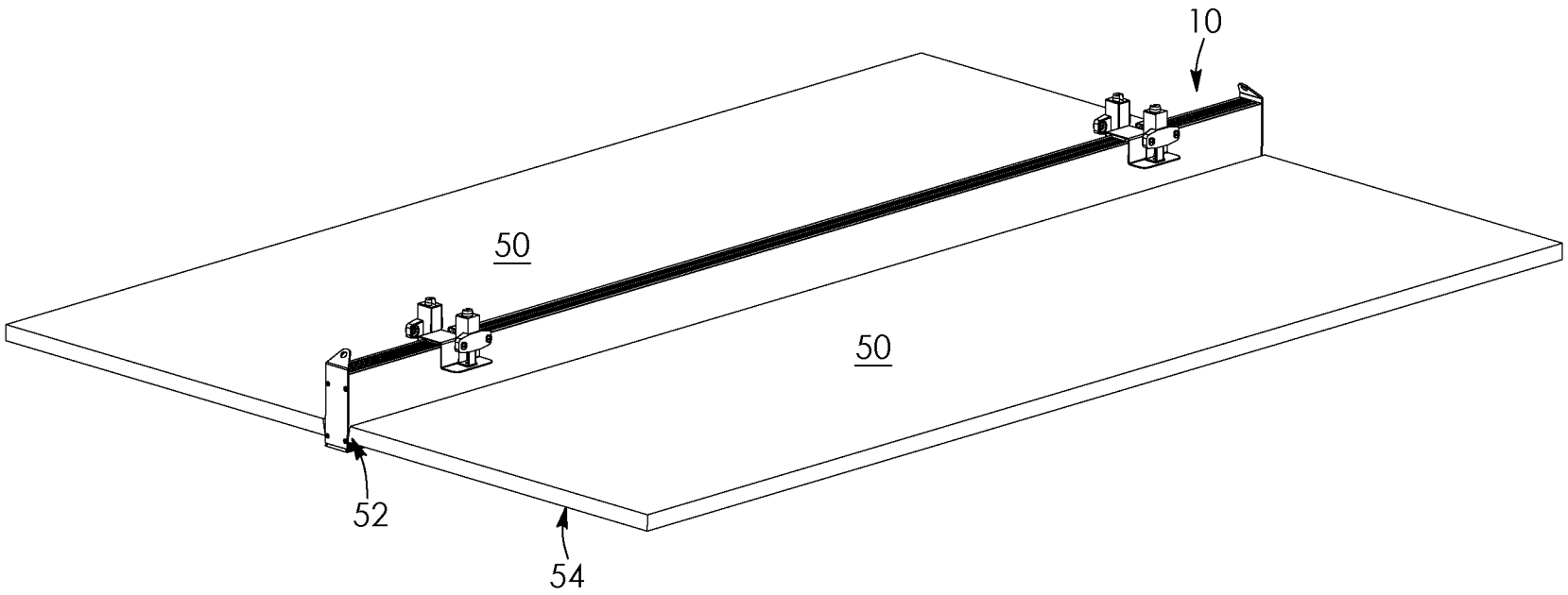
FIG. 1 is a perspective view of a lighting assembly installed within a cavity of a structure, according to an embodiment.

In the following description, the same numerical references refer to similar elements. Furthermore, for sake of simplicity and clarity, namely so as to not unduly burden the figures with several reference numbers, not all figures contain references to all the components and features described herein and references to some components and features may be found in only one figure, and components and features illustrated in other figures can be easily inferred therefrom. The embodiments, geometrical configurations, materials mentioned and/or dimensions shown in the figures are optional, and are provided for illustrative purposes only.

In addition, although the optional embodiments described herein and as illustrated in the accompanying drawings comprises various components, and although they may consist of certain geometrical configurations as explained and illustrated herein, not all of these components and geometries are essential to the invention and thus should not be taken in their restrictive sense, i.e. should not be taken as to limit the scope of the present disclosure. It is to be understood that other suitable components and cooperations thereinbetween, as well as other suitable geometrical configurations may be used for the lighting assembly, as briefly explained and as can be easily inferred herefrom, without departing from the scope of the disclosure.

In accordance with one aspect of the present invention, there is provided a lighting assembly mounted within a cavity of a structure having an exposed outer face.

Embodiments of the lighting assembly can be used to illuminate an indoor space such as a room, hall, or chamber, and can also be used to illuminate outdoor areas such as yards, patios, balconies, terraces, walkways, and other similar constructions.

The structure to which the lighting assembly is mounted can be any arrangement or interrelationship of constructions that provide a frame in which the lighting assembly can be installed. In typical implementations, the structure may be embodied by a ceiling, and the lighting assembly therefore embodies a ceiling light which appears to an observer to extend along the same plane as the ceiling itself, or appears recessed within the ceiling, thereby improving the overall aesthetic appearance of the arrangement. The lighting assembly can also be accessed, or its components removed from the cavity, which facilitates the work related to its maintenance and its replacement. However, although the illustrated example relates to a ceiling light, it will be readily understood that lighting assemblies according to other embodiments of the invention may alternatively be used in structures of other types without departing from the scope of the present invention. Additional examples of structures in which the lighting assembly may be mounted include walls, floors, shelves, cabinets, and the like. In some implementations, the structure may be embodied by a box, case, or frame that need not necessarily be encompassed in a ceiling or a wall, and may for example be provided as an external lighting component mounted under a ceiling or on a wall. The structure is not limited to planar objects, and can also include curved constructions.

The cavity of the structure may be embodied by any recess, hole, depression, or other empty space within the structure. In some implementations, the cavity is sized and constructed to receive the lighting assembly. It will be readily understood that the cavity may have any suitable size, orientation, or configuration which best suits the lighting assembly placed therein. For example, where the structure is a ceiling, the cavity may for example be embodied by a vertical depression in the ceiling. In another example, where the structure is a wall, the cavity may for example be embodied by a horizontal depression in the wall. In another example, where the structure is a cabinet, the cavity may be embodied by an interior void within the cabinet.

As mentioned above, the structure has an exposed outer surface. The term "exposed" may be understood as referring to a surface which can be observed by the naked eye. The term "outer" is understood to refer to the part of the surface which generally faces away from the cavity and the interior of the structure, and towards the space being illuminated. In the example where the structure is a ceiling, the exposed outer surface is for example embodied by the face of the ceiling which is visible to an observer. In the example where the structure is a wall, the exposed outer surface may similarly be embodied by the face of the wall which can be observed. As mentioned above, the exposed outer surface need not be planar and may have a curved or irregular profile without departing from the scope of the invention.

Referring to FIG. 1, there is shown an example of a lighting assembly 10 according to one embodiment. In the illustrated example, the structure 50 in which the lighting assembly is mounted is embodied by a ceiling in which an elongated rectangular opening defines the cavity 52. The outer surface 54 of this embodiment is defined by the face of the ceiling facing inwardly of the room or area below the ceiling and visible to individuals within this room.

Lighting Source

Figure 2:
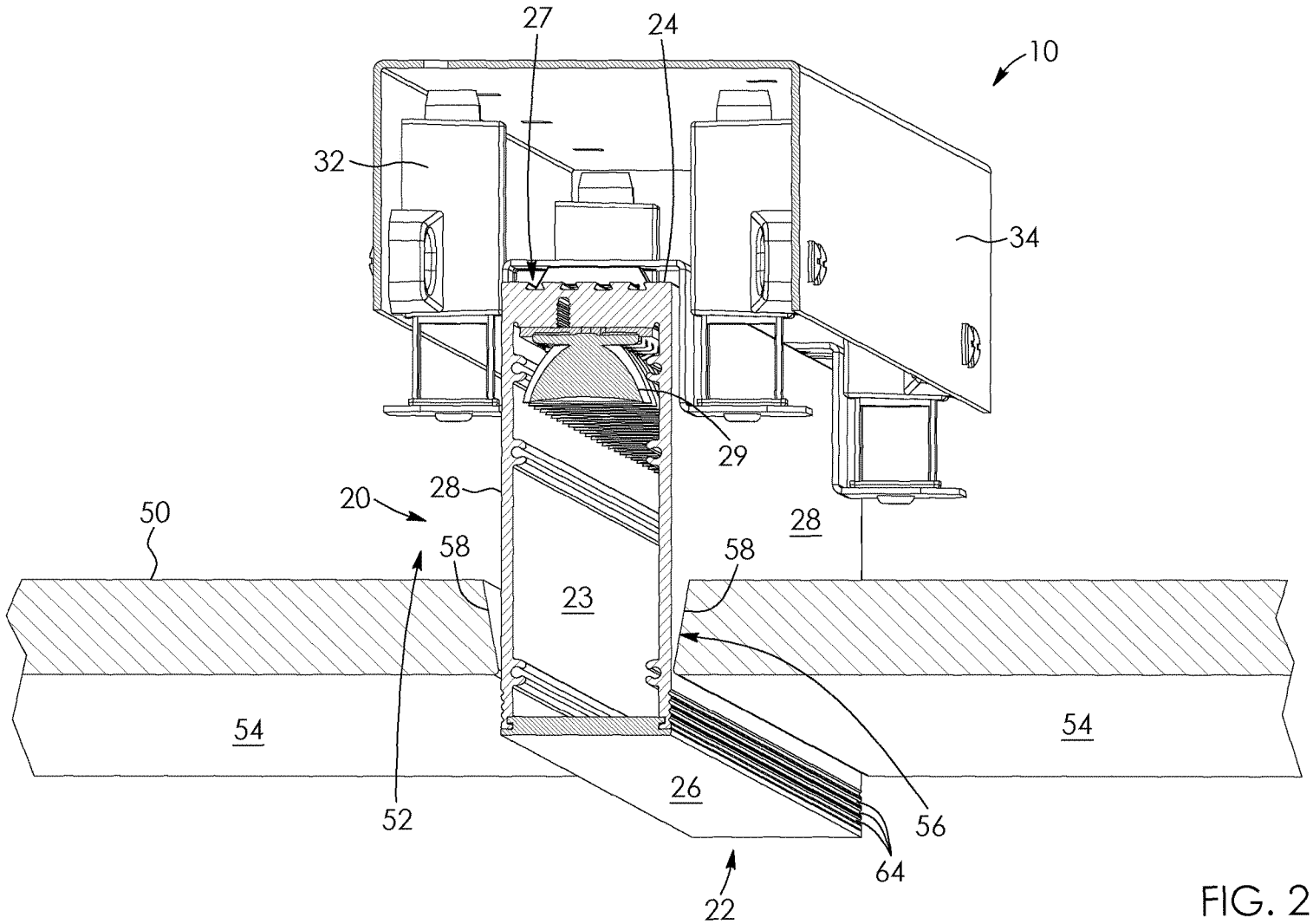
FIG. 2 is a perspective view of a lighting assembly being shown in an extended position, according to an embodiment.

Referring to both FIGS. 1 and 2, the lighting assembly 10 first includes a lighting source 20 having a light output surface 26.

The lighting source 20 may be embodied by any device which is apt to generate light and which can be mounted within the cavity 52, and thus can take many forms. In some embodiments, the lighting source 20 includes one or more light emitters 29, such as a LED, incandescent, fluorescent, halogen, metal-halide, or sodium light bulb or tube, or the like. The lighting source 20 may include light emitters 29 of more than one type without departing from the scope of the invention. The number and type of light emitters may be selected according to lighting design, functional and aesthetical considerations as will be readily understood by one skilled in the art.

In some implementations, the lighting source 20 also includes a housing 22, and the light emitter or emitters 29 are preferably enclosed in this housing 22. In the illustrated embodiment, the housing 22 is shaped as a rectangular polyhedron, having a vertical orientation, and which defines an enclosure 23. The enclosure 23 is defined by a top wall 24, the light output surface 26 which extends in parallel and opposite to the top wall 24, and opposed side walls 28. End walls (not shown) may be provided at side extremities of the polyhedron formed by the housing 22 in order to complete the enclosure 23. Components of the housing 22, such as for example the top wall 24, side walls 28, and end walls, can be made of or include a thermally-dissipating material, such as for example, aluminum, copper or brass. In an optional embodiment, the lighting source 20 may further include one or more heat sink (not shown) for thermal dissipation of heat generated by the light emitters 29. The one or more heat sink may be embodied by a metallic or otherwise heat dissipative portion of the housing 22, for example the top wall 24. In other variants, the heat sink may be embodied by an additional component put in thermal contact with the light emitters.

In typical implementations the housing 22 can protect the components contained therein from impacts, and can also provide a graspable interface for a user or technician so as to remove the housing 22 for replacement or repair. Such a housing can advantageously be easily gripped by a technician so as to be removed, and can also be easily inserted back into the cavity 52.

In some embodiments, the housing can include a shielding element such as a baffle or a louver (not shown) to better conceal the light emitters 29 from view. In some embodiments, the baffle or louver may extend beyond the outer surface 54. In further embodiments, such as shown in FIG. 2 the side walls 28 can display grooves 64 or motifs helping a technician discerning the housing from the outer surface 54.

The light emitters 29 can be mounted to the housing 22 by any suitable technique, and be positioned within the enclosure 23 in any appropriate fashion. In some implementations, the light emitters 29 can be positioned towards one of the top or bottom ends of the housing 22. For example, in the illustrated embodiments the light emitters 29 are attached to the top wall 24 inside the housing 22 such that the light generated by these emitters 29 travel downward within the housing 22 and escape from the housing through the light output surface 26. Such an arrangement can advantageously allow the light emitters 29 to be recessed within the cavity 52, which better conceals them from view and offers an additional measure of protection against impacts and allows better light performances.

Optionally, in embodiments where a plurality of light emitter 29 are provided within the housing 22, these light emitters 29 may be arranged in an elongated row so as to provide illumination over a given length. One skilled in the art will understand that other arrangements of the light emitters 29 are also possible and within the scope of the present disclosure.

Figure 5:
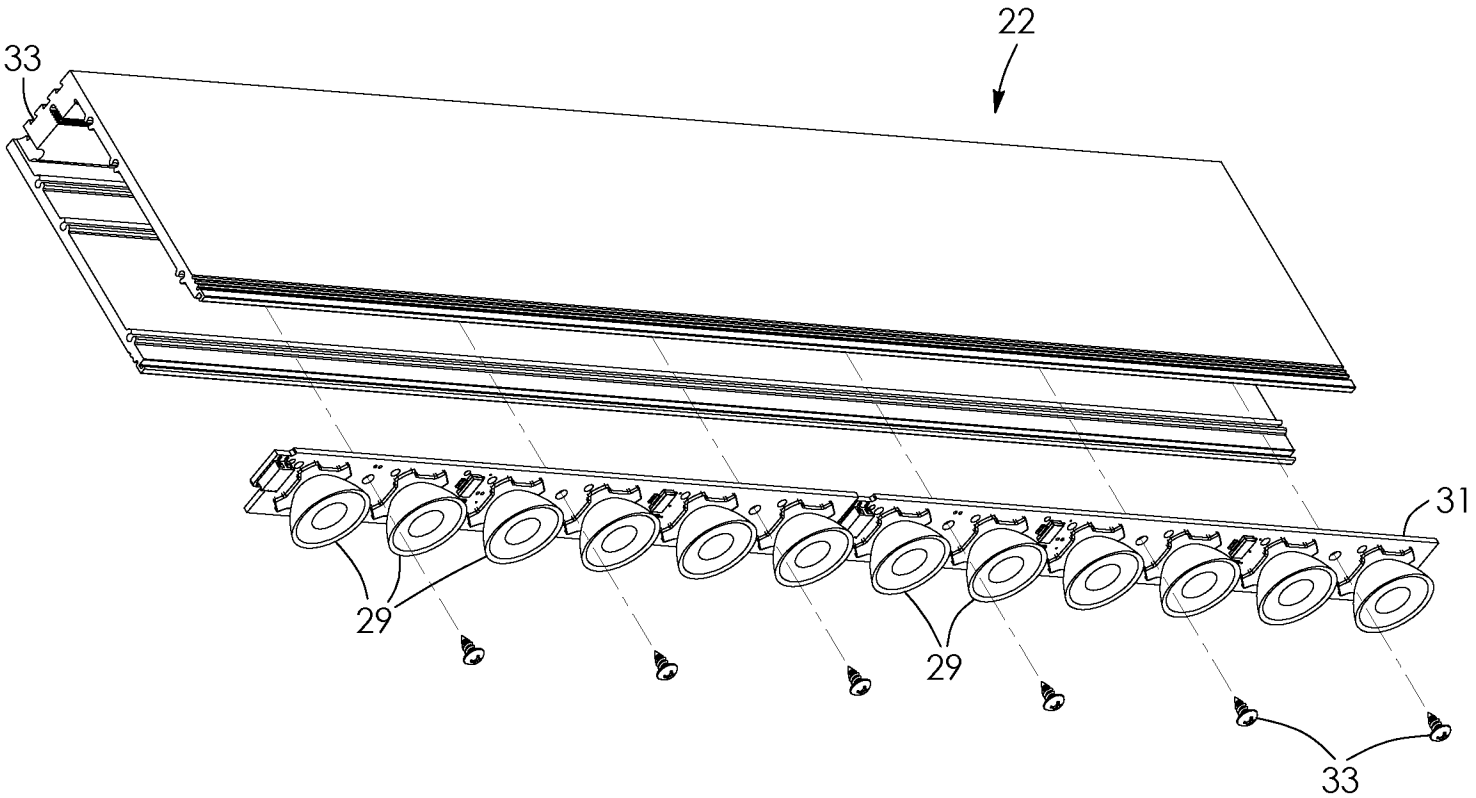
FIG. 5 is a perspective exploded view of a portion of the housing of a light source and the light emitters mounted in this housing, according to an embodiment.

Referring to FIG. 5, there is shown an example of a manner in which the light emitters 29 may be mounted in the housing 22. In the illustrated configuration, the light emitters 29 are embodied by a plurality of circular LEDs mounted at regular intervals along a PCB strip 31. The LEDs may be clipped or slipped in appropriate slots in the PCB strip 31 or otherwise attached to the PCB strip through appropriate fasteners. The PCB strip 31 is affixed to the top wall 24 of the housing 22 through a plurality of screws 33 or the like. Of course, this configuration is shown by way of example only and a variety of other implementations could be considered without departing from the scope of the present description.

Referring back to FIG. 2. the light output surface 26 may be embodied by any component defining a face or area through which the light generated within the lighting source 20 can exit so as to illuminate the room or space in which the lighting assembly 10 is provided. In the illustrated embodiment, the light output surface 26 can for example be embodied by a plate made of a light-transmitting material, such as glass or plastic, so as to allow light generated from within the housing 22 to be transmitted out of the cavity 52. In one embodiment the light-transmitting material has a light-diffusion texture, for example an optical filter and the like, made of Poly(methyl methacrylate) (PMMA), polycarbonate or other plastics or the like, such that the light transmitted thereby is diffuse and the inside of the housing 22 is not viewable through the light output surface 26. In other possible embodiments, the light-transmitting material is transparent, and can be made of a clear plastic or glass, such that the light transmitted thereby is concentrated and the inside of the housing 22 is viewable through the light output surface 26. The light output surface 26 may also incorporate lens elements directing light according to predetermined patterns. Optionally, the light-transmitting material can have anti-scratch properties for enhancing the life time of the light output surface 26 as a whole.

Referring back to FIG. 2, the lighting source 20 is displaceable within the cavity 52. The term "displaceable" refers to the ability of the lighting source 20 to move within the cavity 52 so as to be retracted therein so that most, and possibly all, of the lighting source 20 can be concealed from view. The term "displaceable" also refers to the ability of the lighting source 20 to be retracted within the cavity 52 when required. In the example where the structure 50 is a ceiling and the cavity 52 is vertically oriented, the lighting source 20 can be displaced vertically up and down. In the example where the structure 50 is a wall and the cavity 52 is horizontally oriented, the lighting source 20 can be displaced horizontally into and out of the wall.

In some optional embodiments, the lighting source 20 can be pivoted so as to adjust the orientation of its light field. In the optional embodiment shown in FIG. 2, the lighting source 20 can be pivoted along an angle range corresponding to an opening 56 in the cavity 52. More specifically, the opening 56 can have inclined surfaces 58 which delimit the available angular rotation of the lighting source 20 within the cavity 52. The ability to pivot the lighting source 20 advantageously allows the light field produced by the source to be adjusted either when installing the lighting assembly 10, or after it has been installed.

Push-Retract Mechanism

Figure 3:
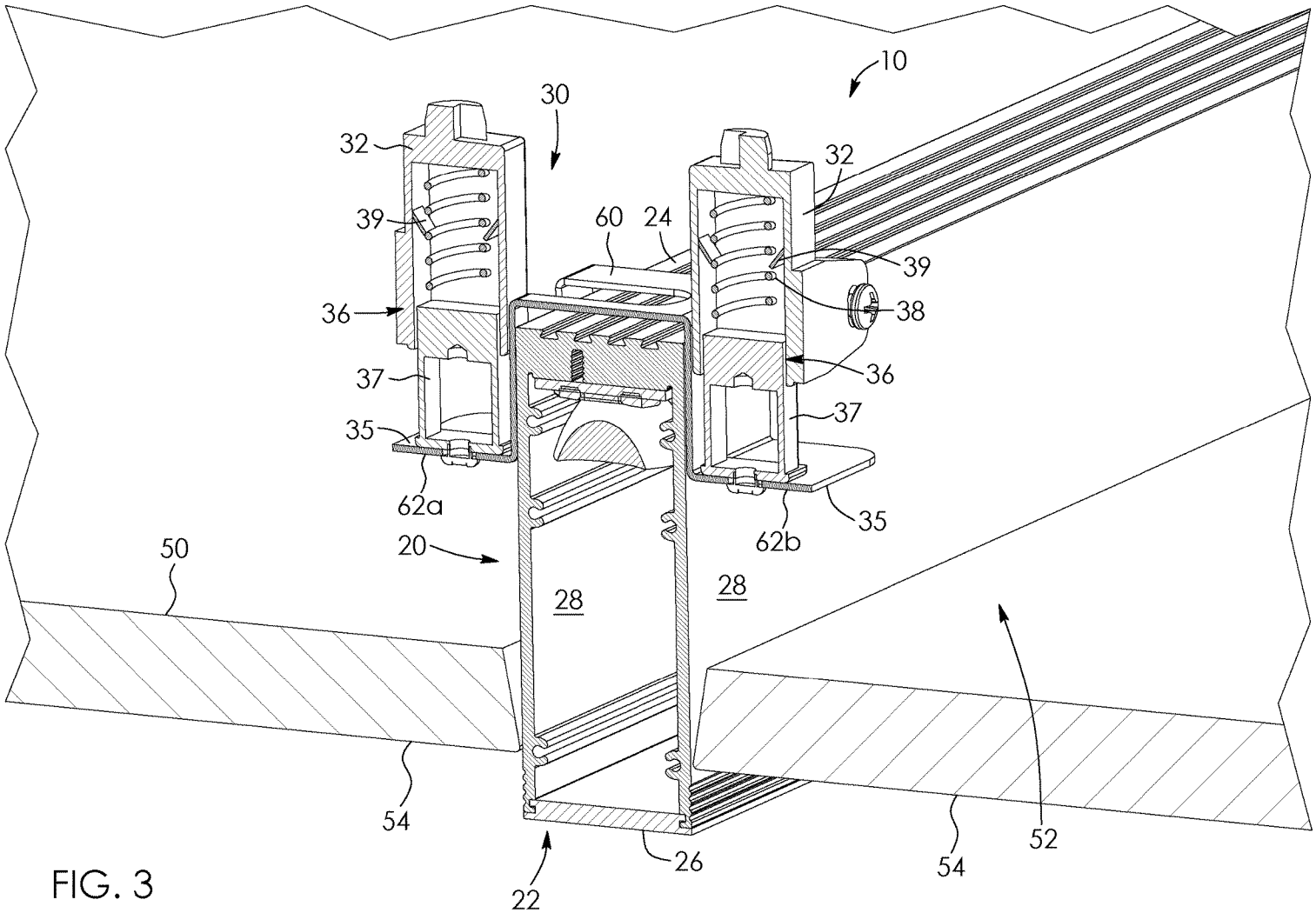
FIG. 3 is a perspective view of a lighting assembly being shown again in an extended position, and further showing a push-retract mechanism, according to an embodiment.
Figure 4:
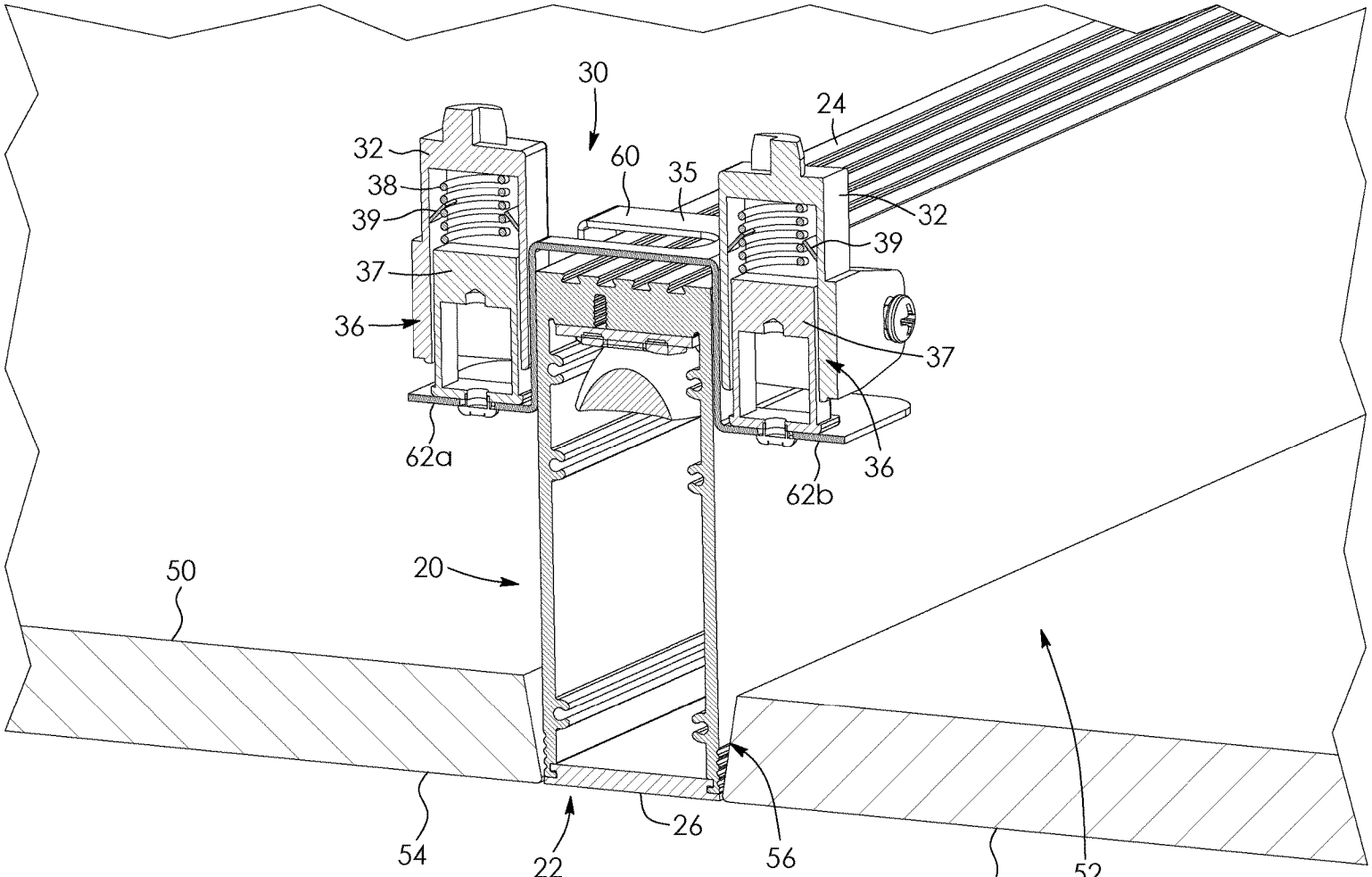

Referring to FIGS. 3 and 4, the lighting assembly 10 further includes a push-retract mechanism 30, having one or more biasing assembly 36 to which the lighting source 20 is attached. As will be clear from the description below, the biasing assembly 36 or assemblies is operable to displace the lighting source 20 between two different positions within the cavity 52: an extended position (see FIG. 3), where the light output surface 26 extends beyond the outer surface 54 of the structure 50, and a retracted position (see FIG. 4), where the light output surface 26 does not extend beyond the outer surface 54 of the structure 50.

The push-retract mechanism 30 provides the force required to displace the lighting source 20 so as to retract and reveal it, through the moving of the lighting source 20 in opposite directions between the extended and retracted positions. The term "opposite" refers to the direction the lighting source 20 travels when being displaced between the positions mentioned above. More specifically, the extended position can be reached by displacing the lighting source 20 in one direction, while the retracted position can be reached by displacing the lighting source 20 in another, opposite, direction.

Each biasing assembly 36 may be embodied by any suitable group of components which can cooperate to produce a biasing force on the lighting source 20 which is sufficient to pushes the lighting source 20 out of the cavity 52 and into the extended position. The push-retract mechanism 30 of the embodiment of FIGS. 3 and 4 includes two biasing assemblies 36, respectively disposed on either side of the housing 22 of the light source 20 in alignment with each other. The push-retract mechanism 30 according to this embodiment further includes two fixtures 32, each associated with a corresponding one of the biasing assemblies 36. Each fixture defines an opened-bottom rectangular space in which is received the corresponding biasing assembly 36.

In the illustrated embodiment, each biasing assembly 36 includes a biasing device 38, which can be a spring or the like, and which can produce the biasing force. The biasing assembly 36 can also include a force transmitter 37, which is displaceable within the cavity 52 in response to the biasing force and/or input force. Still referring to FIGS. 3 and 4, in the illustrated embodiment the force transmitter 37 is for example embodied by a rectangular-shaped frame member sized to slide within the rectangular space of the fixture 32, and the spring embodying the biasing device 38 is positioned between the top of the force transmitter 37 and an inner wall of the fixture 32. It will be readily understood that in other variants, the force transmitter 37 may take a variety of other forms or configurations provided that it can receive and transmit the biasing force.

In some embodiments, the biasing assembly 36 can also include a release mechanism 39, which cooperates with the biasing device 38. The release mechanism 39 can restrain the biasing force produced by the biasing device 38, and can also release the same biasing force.

Various mechanisms which allow a component to be engaged in one of two alternative positions are well known in the art. Such mechanisms may for example include cams following alternative paths in and out of engagement with a restraining component, and may involve cam followers, studs, rollers, bearing and the like such as well known in the art.

When the push-retract mechanism 30 is in the retracted position, the release mechanism 39 can restrain the biasing force produced by the biasing device 38, thereby preventing the biasing force from pushing the lighting source 20 away from the cavity 52 and maintaining the lighting source 20 in the retracted position. Further pushing against the biasing mechanism will relieve the release mechanism 39 from engagement with the biasing device 38, as shown in FIG. 3, thereby allowing the biasing force to act against the lighting source 20, and pushing the lighting source 20 out of the cavity 52 and into the extended position.

Still referring to FIGS. 3 and 4, the push-retract mechanism 30 may include a displacement mounting 35 mechanically linking the biasing assemblies 36 and the lighting source 20. The displacement mounting 35 may for example be embodied by a single thin piece of material, for example made of metal, folded to define a U-shaped portion 60 fitting over the top of the housing 22 of the light source 20 and attached thereto, and a pair of radially projecting flanges 62*a*, 62*b*. The bottom of the force transmitter 37 of each biasing assembly 36 is affixed to a corresponding one of the flanges 62*a*, 62*b*. In this manner, the biasing force applied to each force transmitter 37 can be indeed transferred to the displacement mounting 35 and as a result move the lighting source 20 within the cavity.

It will be readily understood that the displacement mounting 35 forms the link between the force transmitter 37 and the lighting source 20, thereby allowing the biasing force to be transferred from each biasing assembly 36 to the lighting source 20, and also allowing an input force to be transferred from the lighting source 20 to the biasing assembly 36. The displacement mounting 35 may be displaced with the lighting source 20 and the force transmitter 37, and may thus be displaceable within the cavity 52 as well.

In some embodiments, the top wall 24 or the side walls 28 of the housing 22 may be removably mounted to the biasing assembly 36. Alternatively, the top wall 24 of the housing 22 may be removably mounted to the displacement mounting 35. The expression "removably mounted" refers to the manner by which the housing 22, and thus the lighting source 20, is affixed to the push-retract mechanism 30, such that the lighting source 20 can be temporarily connected to the push-retract mechanism 30, and also removed therefrom (i.e. for inspection or repair purposes, for example).

In some embodiments, the top wall 24 of the housing 22 may include an attachment mechanism 27 so as to allow the housing 22 to attach and detach from the push-retract mechanism. The attachment mechanism 27 can be a grooved extrusion (not shown) running the length of the top wall 24 which can mate with a corresponding protrusion (not shown) under or beside the biasing device 38, or under displacement mounting 35. Alternatively, the attachment mechanism 27 can consist of a magnetic strip for engaging a strip of opposed polarity. In other variants, the attachment mechanism can consist of male adaptors located on the displacement mounting 35 or the biasing assembly 36 and designed to complement female adaptors located on the top wall of the housing 22. Further alternatively, the attachment mechanism 27 can consist of knock-down fasteners. Alternatively, the attachment mechanism 27 may be located or mounted onto the side walls 28. In other embodiments, the displacement mounting may be integrally formed as part of the housing of the lighting assembly, negating the need for an attachment mechanism therebetween.

The manner by which the push-retract mechanism 30 is mounted within the cavity 52 can vary depending on the nature of the cavity 52, and the orientation of the lighting assembly 10, among other possible factors. For example, the push-retract mechanism 30 can be mounted to a mounting cover 34, an example of which is shown in FIG. 2. The mounting cover 34 can be permanently attached or installed within the cavity 52 during construction of the structure 50. For example, the mounting cover 34 can be a U-channel or other permanent attachment. Once the mounting cover 34 is in place within the cavity 52, the push-retract mechanism 30 can be affixed thereto, using any suitable fastener known in the art such as bolts, nails, rivets, etc. Referring to FIG. 2, in the illustrated embodiment, each fixture 32 of the push-retract mechanism 30 is attached from the side to the mounting cover 34 through one or more bolts. It will be readily understood that in other variants, push-retract mechanism 30 may be affixed to a structural element of the cavity 52 through any suitable fastener, link, connection, or other similar device.

It will be readily understood that although a single push-retract mechanism, here including two biasing assemblies, has been described above, a number of such push-retract mechanisms may be provided along the lighting source, depending on factors such as the length of the lighting source, its weight, the necessity for additional support or flexibility of movement, etc. Indeed, in the view shown in FIG. 1 two push-retract mechanisms as shown towards two extremities of the light source.

Moreover, it will be readily understood that the components of the lighting assembly 10 collectively allow for the light emitters 29 to being provided with electricity, for example through electrical cables or wires (not shown). Referring to FIG. 2, in an optional embodiment, the housing may feature a hole for this sake.

Having defined and discussed the individual components and features of some of the embodiments of the present invention, an example of the cooperation of the push-retract mechanism 30 with the lighting source 20 and its light output surface 26 will now to be described so as to better understand the transition between the extended and retracted positions.

In the extended position, an example of which is shown in FIG. 3, the light output surface 26 of the lighting source 20 extends beyond the outer face 54 of the structure 50. The expression "extends beyond" refers to the location of the light output surface 26 away from the cavity 52, such that the light output surface 26, or a portion of the lighting source 20, is visible to an observer because it is projected from the cavity 52. In most optional embodiments, but not necessarily all, the light output surface 26, and perhaps a portion of the side walls 28 of the housing 22, extends beyond the outer surface 54. The extended position advantageously exposes the lighting source 20 to view such that a user or technician can access it.

In the retracted position, an example of which is shown in FIG. 4, the light output surface 26 does not extend beyond the outer surface 54 of the structure 50. The expression "does not extend beyond" refers to location of the light output surface 26 with respect to the outer surface 54, such that the light output surface 26 is either recessed within the cavity 52, or is substantially level with the outer surface 54 of the structure 50. The expression "substantially level" refers to the location of the light output surface 26 with respect to the outer surface 54, in that the light output surface 26 is roughly even with the outer surface 54. For example, in the optional embodiment where the structure 50 is a ceiling, the light output surface 26 would be roughly even with the exposed face of the ceiling when it is in the retracted position. When the light output surface 26 is substantially level with the outer surface 54, the retracted position advantageously creates a relatively seamless transition in the structure 50 between the opening in the cavity 52 and the boundaries of the lighting source 20, thereby providing a visually-appealing source of light which seems to form part of outer surface 54 the structure 50.

The transition from the extended to the retracted position, and vice versa, can be accomplished by any suitable technique. In some optional embodiments, the push-retract mechanism 30 can be activated or released by the touch of a user or technician. This push-retract mechanism 30 can be known as a "push-click" mechanism, such as those used in retractable pens or with the drawers in cabinets. The push-retract mechanism 30 can operate as follows.

In order to transition to the retracted position, the lighting source 20, already in the extended position, can receive the input force, such as push from a finger or a tool, towards the cavity 52. The force input can be applied such that the finger or tool ingress into the cavity 52 until an audible "click" is heard, signaling that the housing 22 has engaged the push-retract mechanism 30. Typically, the lighting source 20 will "bounce-back" after the finger or tool is removed and the force input is no longer applied. The displacement to which the light output surface 26 bounces back and settles will be a level that is either substantially flush with the outer surface 54, or retracted within the cavity 52.

Similarly, in order to transition to the extended position, the lighting source 20, already in the retracted position, can receive another application of the input force from a finger or tool, for example. The finger or tool can again ingress into the cavity 52 until another audible "click" is heard, signaling that the housing 22 has been released by the push-retract mechanism 30 from the retracted position. The push-retract mechanism 30 then applies the biasing force in a direction away from the cavity 52, thereby pushing the lighting source 20 out of the cavity 52 and into the extended position.

A method for installing the lighting assembly may be described as follows.

Referring to FIG. 2, step a) involves mounting the push-retract mechanism 30 within the cavity 52. This mounting can be achieved by using the fixtures 32, as discussed above, so as to secure the push-retract mechanism 30 within the cavity 52.

FIG. 3 illustrates step b) of the method, which involves removably mounting the lighting source 20 to the push-retract mechanism 30. In some optional embodiments, the top wall 24 of the housing 22 can be mounted to the displacement mounting 35 of the push-retract mechanism 30.

FIG. 4 illustrates step c) of the method, which involves applying the input force to the lighting source 20 until the light output surface 26 does not extend beyond the outer face 54 of the structure 50. This step can further include locking the lighting source 20 in this retracted position.

It may thus now be appreciated that the lighting assembly 10 described herein represents advantages over other devices known in the art. Indeed, the lighting assembly 10 allows for a relatively seamless continuity in the outer surface 54 of the structure 50 in which it is located when it is flush with the outer surface 54, in contrast to some known pot lights whose rims are visible to an observer.

Furthermore, the displaceable lighting source 20 can be easily attached to, and removed from, the cavity 52 within the structure. This can advantageously allow for reduced labor related to the installation, repair, and replacement of the lighting source 20 and its components.

Further advantageously, the push-retract mechanism 30 offers a convenient way to install the lighting source 20, to retrieve it, and to have it installed flush or recessed within the outer surface 54 of the structure 50. Indeed, and in contrast to some prior art lights, the push-retract mechanism 30 can significantly reduce the amount of time need to repair the light emitters 29, for example.

It will be readily understood that the components of a lighting assembly such as described above may be provided as a set or kit allowing installation of the assembly in a cavity of a structure. Such a set may include the light source, which may or may not be preassembled, as well as the basic components of one or more push-retract mechanisms such as the biasing device, fixture force transmitter, displacement mounting, etc.

Of course, numerous modifications could be made to the above-described embodiments without departing from the scope of the invention.

The invention claimed is:

1. A lighting assembly mounted within a cavity of a structure having an exposed outer surface, the assembly comprising:

a lighting source comprising a light emitter and a light output surface; and a push-retract mechanism comprising at least one biasing assembly operable to displace the lighting source between an extended position where the light output surface extends beyond the outer surface of the structure, and a retracted position, where the light output surface does not extend beyond the outer surface of the structure, and wherein the light emitter does not extend beyond the outer surface of the structure in both the extended position and the retracted position.

2. The lighting assembly according to claim 1, wherein the push-retract mechanism further comprises a displacement mounting mechanically linking the at least one biasing assembly and the lighting source.

3. The lighting assembly according to claim 2, wherein the lighting source is attached to the displacement mounting.

4. The lighting assembly according to claim 1 wherein, when the push-retract mechanism is in the retracted position, the light output surface of the lighting source is substantially level with the outer surface of the structure.

5. The lighting assembly according to claim 1 wherein, when the push-retract mechanism is in the retracted position, the light output surface is recessed within the cavity.

6. The lighting assembly according to claim 1, wherein the push-retract mechanism comprises a fixture to which the biasing assembly is mounted, the fixture being mounted within the cavity.

7. The lighting assembly according to claim 1, wherein the lighting assembly comprises a mounting cover to which the push-retract mechanism is mounted.

8. The lighting assembly according to claim 1, wherein the light output surface is made of a light-transmitting material having a light-diffusion texture.

9. The lighting assembly according to claim 1, wherein the lighting source comprises: a housing defining an enclosure including said light output surface; and one or more of the light emitters enclosed in said housing.

10. The lighting assembly according to claim 9, wherein the one or more light emitters comprise LEDs, bulbs or fluorescents.

11. The lighting assembly according to claim 9, wherein the housing comprises a top wall opposite the output surface, and the lighting assembly further comprises an attachment mechanism configured to attach the top wall of the housing to the push-retract mechanism.

12. The lighting assembly according to claim 11, wherein the attachment mechanism comprises a grooved extrusion running along a length of the top wall of the housing.

13. The lighting assembly according to claim 1, wherein the biasing assembly comprises a biasing device.

14. The lighting assembly according to claim 13, wherein the biasing device is a spring.

15. The lighting assembly according to claim 1, wherein the push-retract mechanism comprises two of said biasing assemblies disposed on either side of the lighting source.

16. The lighting assembly according to claim 9, wherein the displacement mounting comprises a U-shaped portion fitting over the housing of the light source and attached to the housing of the light source, and a pair of radially projecting flanges each attached to a respective one of the biasing assembly.

17. A set for mounting a lighting assembly within a cavity of a structure having an exposed outer surface, comprising:

a lighting source comprising a light emitter and a light output surface; and a push-retract mechanism mountable within the cavity and to which the lighting source is attachable, comprising at least one biasing assembly operable to displace the lighting source, so that when the push-retract mechanism is mounted within the cavity and the lighting source is attached thereto, the lighting source can be displaced between an extended position where the light output surface extends beyond the outer surface of the structure, and a retracted position, where the light emitter does not extend beyond the outer surface of the structure in both the extended position and the retracted position.

18. The set for mounting a lighting assembly according to claim 17, wherein the push-retract mechanism further comprises a displacement mounting for mechanically linking the at least one biasing assembly and the lighting source.

19. The set for mounting a lighting assembly according to claim 17, further comprises a mounting cover to which the push-retract mechanism is mountable.

20. The set for mounting a lighting assembly according to claim 17, wherein the lighting source comprises: a housing defining an enclosure including said light output surface; and one or more of the light emitters enclosed in said housing.

21. The set for mounting a lighting assembly according to claim 17, wherein the lighting source and the push-retract mechanism are preassembled.

* * * * *